US009121591B2

(12) United States Patent
Chiang

(10) Patent No.: US 9,121,591 B2
(45) Date of Patent: Sep. 1, 2015

(54) LIGHTING DEVICE WITH WIRELESS POWER SUPPLY MODULE

(71) Applicant: INDUSTRIAL TECHNOLOGY RESEARCH INSTITUTE, Hsinchu (TW)

(72) Inventor: Song-Bor Chiang, New Taipei (TW)

(73) Assignee: Industrial Technology Research Institute, Hsinchu (TW)

( * ) Notice: Subject to any disclaimer, the term of this patent is extended or adjusted under 35 U.S.C. 154(b) by 23 days.

(21) Appl. No.: 13/911,582

(22) Filed: Jun. 6, 2013

(65) Prior Publication Data

US 2014/0159575 A1 Jun. 12, 2014

(51) Int. Cl.

| | |
|---|---|
| ***F21V 23/02*** | (2006.01) |
| ***F21V 23/00*** | (2015.01) |
| ***F21V 21/096*** | (2006.01) |

(52) U.S. Cl.

CPC ..... *F21V 23/026* (2013.01); *F21V 23/003* (2013.01); *F21V 21/096* (2013.01)

(58) Field of Classification Search

CPC ..... H01J 13/32; H01J 13/48; H01J 19/36; H05B 37/029; H05B 33/0803; H05B 37/0254

USPC ..... 315/113, 312; 324/300–324

See application file for complete search history.

(56) References Cited

U.S. PATENT DOCUMENTS

| | | | |
|---|---|---|---|
| 4,667,277 | A | 5/1987 | Hanchar |
| 6,065,854 | A | 5/2000 | West et al. |
| 6,660,935 | B2 | 12/2003 | Southard et al. |
| 6,693,551 | B2 | 2/2004 | Pederson |
| 6,816,389 | B1 | 11/2004 | Lutz et al. |
| 6,846,094 | B2 | 1/2005 | Luk |
| 6,994,455 | B2 | 2/2006 | Okabe et al. |
| 7,045,828 | B2 | 5/2006 | Shimizu et al. |
| 7,210,957 | B2 | 5/2007 | Mrakovich |
| 7,322,828 | B1 | 1/2008 | Chiang et al. |
| 7,396,146 | B2 | 7/2008 | Wang |

(Continued)

FOREIGN PATENT DOCUMENTS

| | | | |
|---|---|---|---|
| CN | 101469850 | A | 7/2009 |
| CN | 201437940 | U | 4/2010 |

(Continued)

OTHER PUBLICATIONS

Chiang et al., "The Appearance Design and Thermal Issues of the Modularized LED Lighting Lamp in Various Environment", Journal of Industrial Materials, vol. 281, pp. 84-89, May 2010.

(Continued)

*Primary Examiner* — Dylan White

(74) *Attorney, Agent, or Firm* — Muncy, Geissler, Olds & Lowe, P.C.

(57) ABSTRACT

A lighting device includes a light holder component and a light source component. The light holder component includes a wireless power supply module. The wireless power supply module has a first magnetic element. The light source component includes at least one light source and a wireless electric receiving module. The light source is electrically connected to the wireless electric receiving module. The wireless electric receiving module has a second magnetic element. The second magnetic element is attracted to the first magnetic element to cause the light source component to dispose on the light holder component.

13 Claims, 5 Drawing Sheets

(56) References Cited

U.S. PATENT DOCUMENTS

| | | | | |
|---|---|---|---|---|
| 7,400,029 | B2 | 7/2008 | Shimada et al. | |
| 7,540,761 | B2 | 6/2009 | Weber et al. | |
| 7,585,187 | B2 | 9/2009 | Daily et al. | |
| 7,611,376 | B2 | 11/2009 | Daily et al. | |
| 7,621,752 | B2 | 11/2009 | Lin et al. | |
| 7,677,766 | B2 | 3/2010 | Boyer | |
| 8,390,250 | B2 * | 3/2013 | Washiro | 320/108 |
| 8,461,720 | B2 * | 6/2013 | Kurs et al. | 307/104 |
| 2009/0224856 | A1 * | 9/2009 | Karalis et al. | 333/219.2 |
| 2011/0080053 | A1 * | 4/2011 | Urano | 307/104 |
| 2012/0007519 | A1 * | 1/2012 | Urano | 315/281 |
| 2012/0043825 | A1 * | 2/2012 | Urano | 307/104 |
| 2012/0113657 | A1 | 5/2012 | Wakimoto | |
| 2012/0212150 | A1 * | 8/2012 | Lakirovich et al. | 315/250 |
| 2013/0113423 | A1 * | 5/2013 | Baarman et al. | 320/108 |
| 2013/0147281 | A1 * | 6/2013 | Kamata | 307/104 |
| 2013/0175937 | A1 * | 7/2013 | Nakajo et al. | 315/200 R |
| 2013/0285558 | A1 * | 10/2013 | Recker et al. | 315/153 |

FOREIGN PATENT DOCUMENTS

| | | |
|---|---|---|
| TW | 567619 | 12/2003 |
| TW | 1236334 | 7/2005 |
| TW | 200702824 | 1/2007 |
| TW | 200801395 | 1/2008 |
| TW | M339879 (U) | 9/2008 |
| TW | M342455 | 10/2008 |
| TW | M345446 | 11/2008 |
| TW | M346735 | 12/2008 |
| TW | 200901496 | 1/2009 |
| TW | 200919785 | 5/2009 |
| TW | M360993 | 7/2009 |
| TW | M364281 (U) | 9/2009 |
| TW | I318461 (B) | 12/2009 |
| TW | I318463 | 12/2009 |
| TW | I319473 | 1/2010 |
| TW | M380428 | 5/2010 |
| TW | M395094 U1 | 12/2010 |
| TW | M406326 | 6/2011 |
| TW | M434164 U | 7/2012 |
| WO | WO 2010/150207 A1 | 12/2010 |

OTHER PUBLICATIONS

S.B. Chiang, "The External LED Lighting Module Thermal Simulation and Experimental Results", 27th National Symposium of Chinese Society of Mechanical Engineers, Oct. 2010, pp. 1-5.

S.B. Chiang, "The Development of the Tunable LED PAR Lamp", Journal of Industrial Materials, vol. 295, pp. 134-138, Jul. 2011.

U.S. Dept. of Energy, "Roundtable Discussions of the Solid-State Lighting R&D Task Priorities", Jan. 2012, pp. 1-34.

U.S. Dept. of Energy, "Solid State Lighting Resdearch and Development: Multi Year Program Plan", Mar. 2011, pp. 1-102 + Appendix A-G.

U.S. Dept. of Energy, "Solid State Lighting Resdearch and Development: Multi Year Program Plan", Apr. 2012, pp. 1-104 + Appendix A-H.

U.S. Dept. of Energy, "Solid State Lighting Resdearch and Development: Manufacturing Roadmap", Jul. 2011, pp. 1-79.

J. Brodrick, "LED and OLED Sold State Lighting: A Look Ahead", NEMA electroindustry, Feb. 2011, pp. 8-9.

"Lighting Japan & Nepcon Japan & Automotive World 2012—Post Show Report 2012", 41st Electronics R&D and Manufacturing Technology Expo, pp. 1-17.

* cited by examiner

LIGHTING DEVICE WITH WIRELESS POWER SUPPLY MODULE

CROSS-REFERENCE TO RELATED APPLICATIONS

This non-provisional application claims priority under 35 U.S.C. §119(a) on Patent Application No(s). 101146229 filed in Taiwan, R.O.C. on Dec. 7, 2012, the entire contents of which are hereby incorporated by reference.

TECHNICAL FIELD

The disclosure relates to a lighting device.

BACKGROUND

Changes on social pattern, rapid technological advancement, increase in environmental awareness and progress on environmental concepts have made energy conservation and carbon reduction to become important issues and targets to achieve for most countries in the world. As a result, since the invention of a white light emitting diode (LED) and a white organic light emitting diode (OLED) in the 90's, a light emitting diode has become the best product for replacing a conventional light bulb because it is energy-saving, environmental friendly, mercury-free, compact, applicable in low temperature environments and directional. Moreover, it produces less light pollution and has a wide color gamut.

However, since the light emitting diode lighting devices in the market have its own optical characteristics and heat dissipation requirements, many of the light emitting diode lighting devices are custom-made, and cannot be massively produced in order to reduce the manufacturing costs. Furthermore, because the light and light holder of a custom-made light emitting diode lighting device are mostly fixed with each other by welding, when the light is out of order, the users have to ask the manufacturer to replace the light instead of replacing it themselves. And, it will be less desirable for users to buying light emitting diode lighting devices. Therefore, a way to design a light emitting diode lighting device which can be conveniently replaced by users is highly demanded for developers to provide.

SUMMARY

The disclosure provides a lighting device comprising a light holder component and a light source component. The light holder component comprises a wireless power supply module. The wireless power supply module comprises a first magnetic element. The light source component comprises a wireless electric receiving module and at least one light source. The wireless electric receiving module comprises a second magnetic element. The light source is electrically connected to the wireless electric receiving module. The second magnetic element is attracted to the first magnetic element to cause the light source component to dispose on the light holder component.

BRIEF DESCRIPTION OF THE DRAWINGS

The disclosure will become more fully understood from the detailed description given herein below for illustration only and thus does not limit the disclosure, wherein.

DETAILED DESCRIPTION

Figure 1:
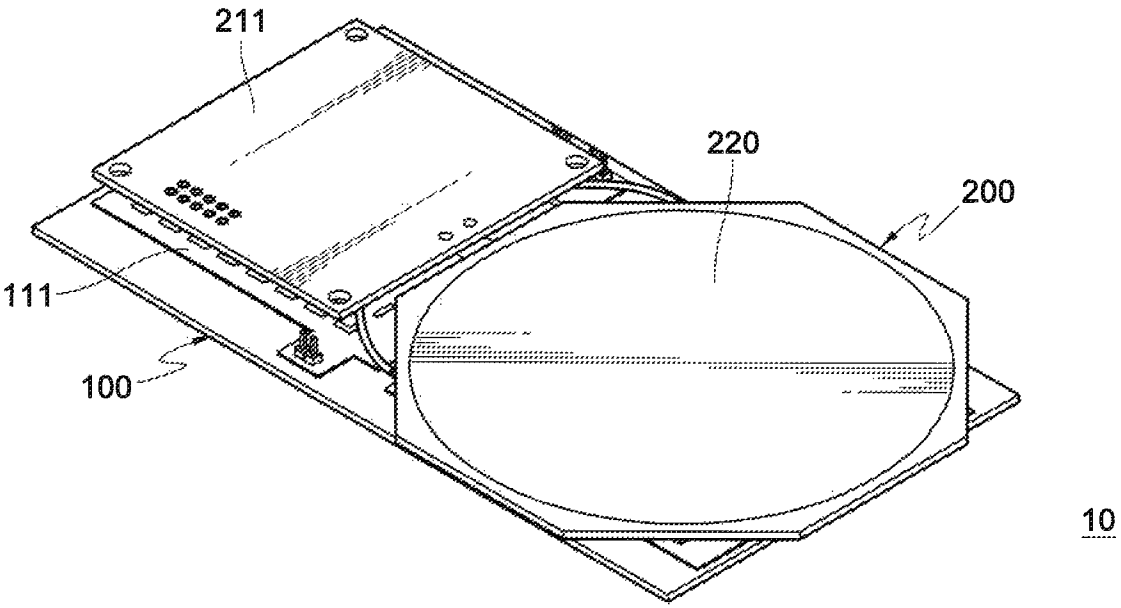
FIG. 1 is a perspective view of a lighting device according to a first embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
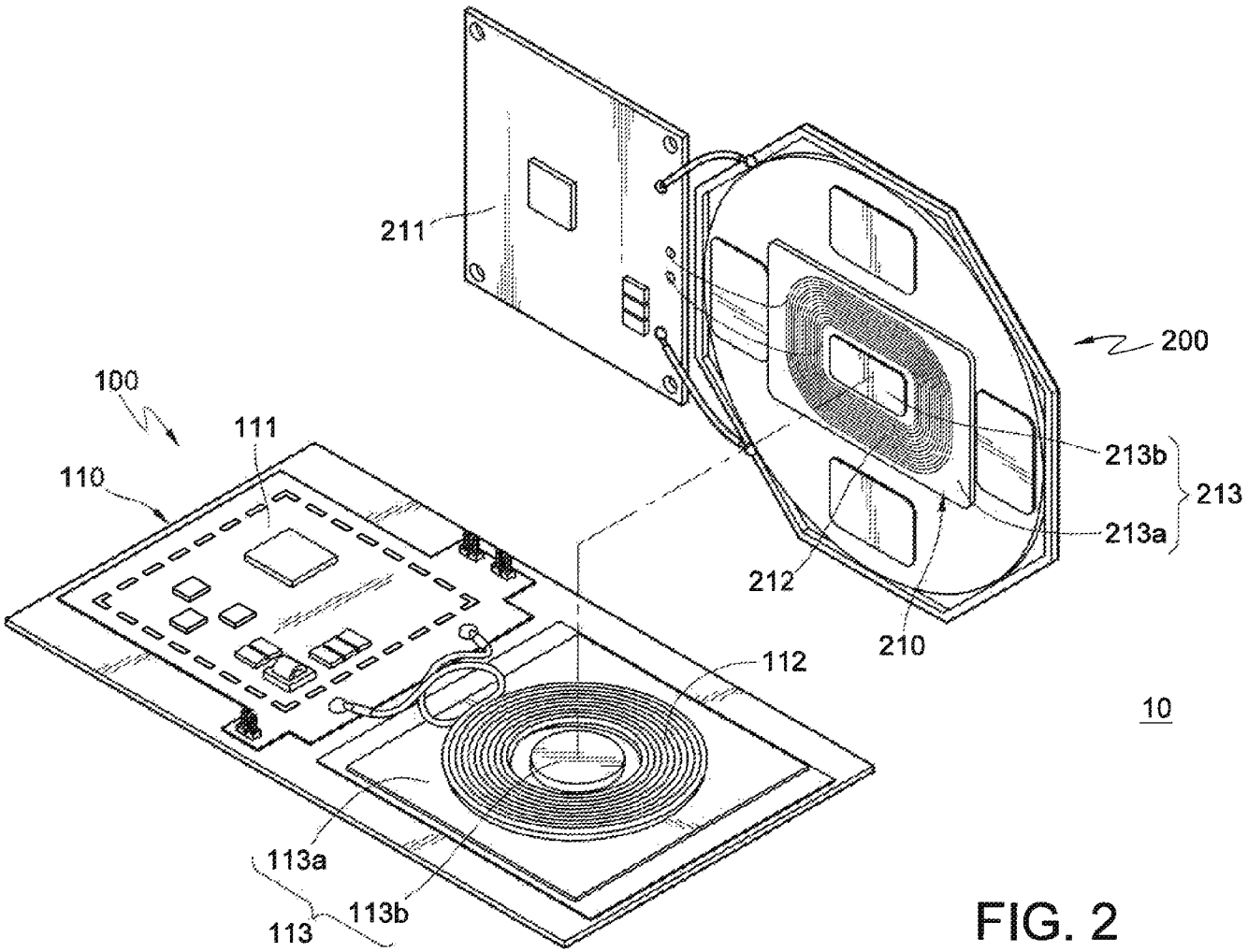
FIG. 2 is an exploded view of FIG. 1.
Figure 3:
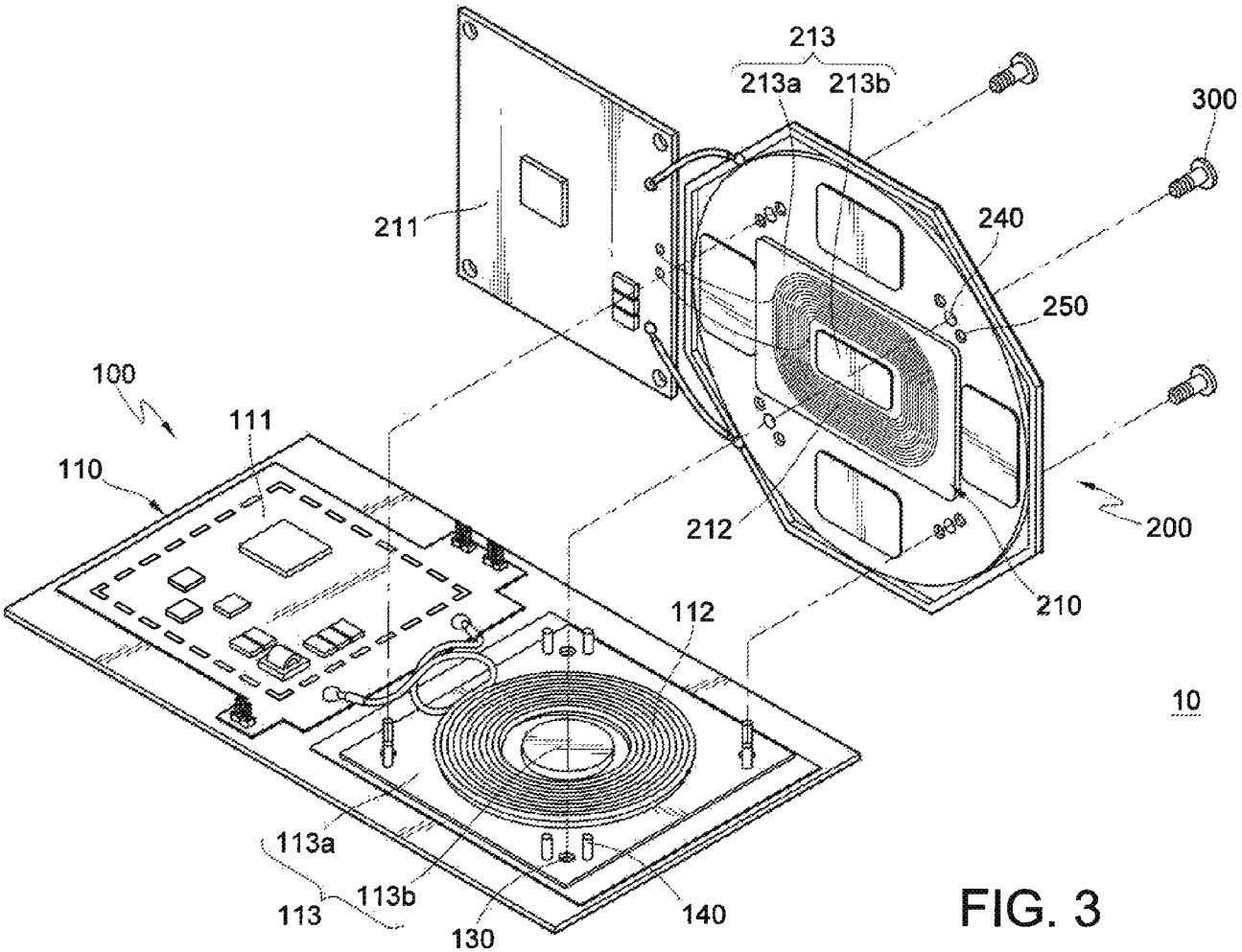
FIG. 3 is an exploded view of the lighting device according to a second embodiment of the disclosure.

Please refer to FIGS. 1 to 3. FIG. 1 is a perspective view of a lighting device according to a first embodiment of the disclosure. FIG. 2 is an exploded view of FIG. 1.

A lighting device 10 of this embodiment comprises a light holder component 100 and a light source component 200.

Specifically, the light holder component 100 comprises a wireless power supply module 110. The wireless power supply module 110 comprises a power supply circuit 111, a power supply coil 112 and a first magnetic element 113. The first magnetic element 113 comprises a first magnet 113*a* and a second magnet 113*b*. The power supply coil 112 and the second magnet 113*b* are adhered on the first magnet 113*a* respectively. The power supply coil 112 surrounds the second magnet 113*b* and is electrically connected to the power supply circuit 111.

The light source component 200 comprises a wireless electric receiving module 210 and at least one light source 220. The wireless electric receiving module 210 comprises an electric receiving circuit 211, an electric receiving coil 212 and a second magnetic element 213. The second magnetic element 213 comprises a third magnet 213*a* and a fourth magnet 213*b*. The electric receiving coil 212 and the fourth magnet 213*b* are adhered on the third magnet 213*a* respectively. The electric receiving coil 212 surrounds the fourth magnet 213*b* and is electrically connected to the electric receiving circuit 211. The fourth magnet 213*b* and the second magnet 113*b* have different magnetic poles. The light source 220 is electrically connected to the electric receiving circuit 211 of the wireless electric receiving module 210. The light source 220 is selected from one of the groups composed of a light emitting diode (LED) or an organic light emitting diode (OLED). In this and some other embodiments, the light source 220 is an organic light emitting diode but it should not be construed as a limitation to the disclosure. The light source component 200 and the light holder component 100 are assembled together by the attraction between the fourth magnet 213*b* of the second magnetic element 213 and the second magnet 113*b* of the first magnetic element 113. Thereby, the light source component 200 and the light holder component 100 are able to be assembled together and detached from each other speedily. Furthermore, when the light source component 200 is disposed on the light holder component 100, the light source component 200 is configured for being supplied with a power required for lighting through the wireless electric receiving module 210 and the wireless power supply module 110. Thereby, the broken light source component 200 is configured for being easily replaced by a user. Also, the broken light source component 200 is configured for being replaced by the light source component 200 with a different lumen and watts based on the requirements.

In this embodiment, both the first magnet 113*a* and the third magnet 213*a* of the lighting device 10 are soft magnets. The principles of how the light source component 200 obtains the power through the wireless electric receiving module 210 and the wireless power supply module 110 are as follows. The power supply coil 112 is electrically conducted to cause the first magnet 113*a* to produce an induced magnetic field. The induced magnetic field of the first magnet 113*a* causes the third magnet 213*a* of the wireless electric receiving module 210 and the electric receiving coil 212 to produce an induced electric current. The induced electric current is transmitted to the light source 220 via the electric receiving circuit 211 to cause the light source 220 to emit light.

Furthermore, because there are no electrical terminals or connectors directly contacted between the light source component 200 and the light holder component 100, the assembling staff will not be hurt, injured or electric shocked by contacting the electrical terminals during the installation of the light source component 200. Additionally, tests for safety standards and requirements for lightings such as CNS 14335, CNS 15233, CIE 127, MIL-HDBK-217F, UL2108, CNS 14165 and CNS 15174 can be omitted. On the other hand, since the light source component 200 and the light holder component 100 are independent modules, the requirements in protection from water and dust can be easily reached.

Both the second magnet 113*b* and the fourth magnet 213*b* of the lighting device 10 of this embodiment are permanent magnets, and therefore the light source component 200 is configured for still being attracted to the light holder component 100 even if the second magnet 113*b* and the fourth magnet 213*b* are not electrically conducted, but it should not be construed as a limitation to the disclosure. In other embodiments, both the second magnet 113*b* and the fourth magnet 213*b* may be soft magnets. Or, the second magnet 113*b* is a permanent magnet and the fourth magnet 213*b* is a soft magnet. Or, the second magnet 113*b* is a soft magnet and the fourth magnet 213*b* is a permanent magnet. However, when the second magnet 113*b* is a soft magnet, the second magnet 113*b* has to be electrically conducted first in order to cause the second magnet 113*b* to become magnetized, therefore the light source component 200 is configured for being attracted to the light holder component 100. Similarly, when the fourth magnet 213*b* is a soft magnet, the fourth magnet 213*b* has to be electrically conducted first in order to cause the fourth magnet 213*b* to become magnetized, therefore the light source component 200 is configured for being attracted to the light holder component 100.

In order to enhance the reliability of the assembling between the light source component 200 and the light holder component 100, in other embodiments, coupling components may be added to enable the light source component 200 to be installed on the light holder component 100 firmly. Please refer to FIG. 2 and FIG. 3. FIG. 3 is an exploded view of the lighting device according to a second embodiment the disclosure. This embodiment is similar to the embodiment in FIG. 1, and therefore the same parts will not be described herein again, only the differences between the two embodiments are described hereinafter.

The lighting device 10 of this embodiment comprises the light holder component 100 and the light source component 200.

The light holder component 100 further comprises four first coupling portions 130. The light source component 200 further comprises four second coupling portions 240. The four first coupling portions 130 are detachably coupled with four second coupling portions 240 respectively. Specifically, the lighting device 10 further comprises four locking elements 300. The locking elements 300 lock each of the first coupling portions 130 with the corresponding second coupling portion 240 respectively in order to install the light source component 200 on the light holder component 100 firmly. Furthermore, the quantity of the first coupling portions 130 and the second coupling portions 240 in this embodiment is four respectively, but it should not be construed as a limitation to the disclosure. In other embodiments, the quantity of the first coupling portions 130 and the second coupling portions 240 may be more than four or less than four.

In this embodiment and some other embodiments, the light holder component 100 further comprises a first positioning portion 140. The light source component 200 further comprises a second positioning portion 250. The first positioning portion 140 is a protruded column and the second positioning portion 250 is a concave groove which matches the protruded column. Nonetheless, it should not be construed as a limitation to the disclosure. The first positioning portion 140 is detachably disposed in the second positioning portion 250. Thereby, in the assembling process between the light source component 200 and the light holder component 100, the relative positions of the light source component 200 and the light holder component 100 can be fixed beforehand by the first positioning portion 140 and the second positioning portion 250, in order to enhance the efficiency of the assembling between the light source component 200 and the light holder component 100.

Figure 4:
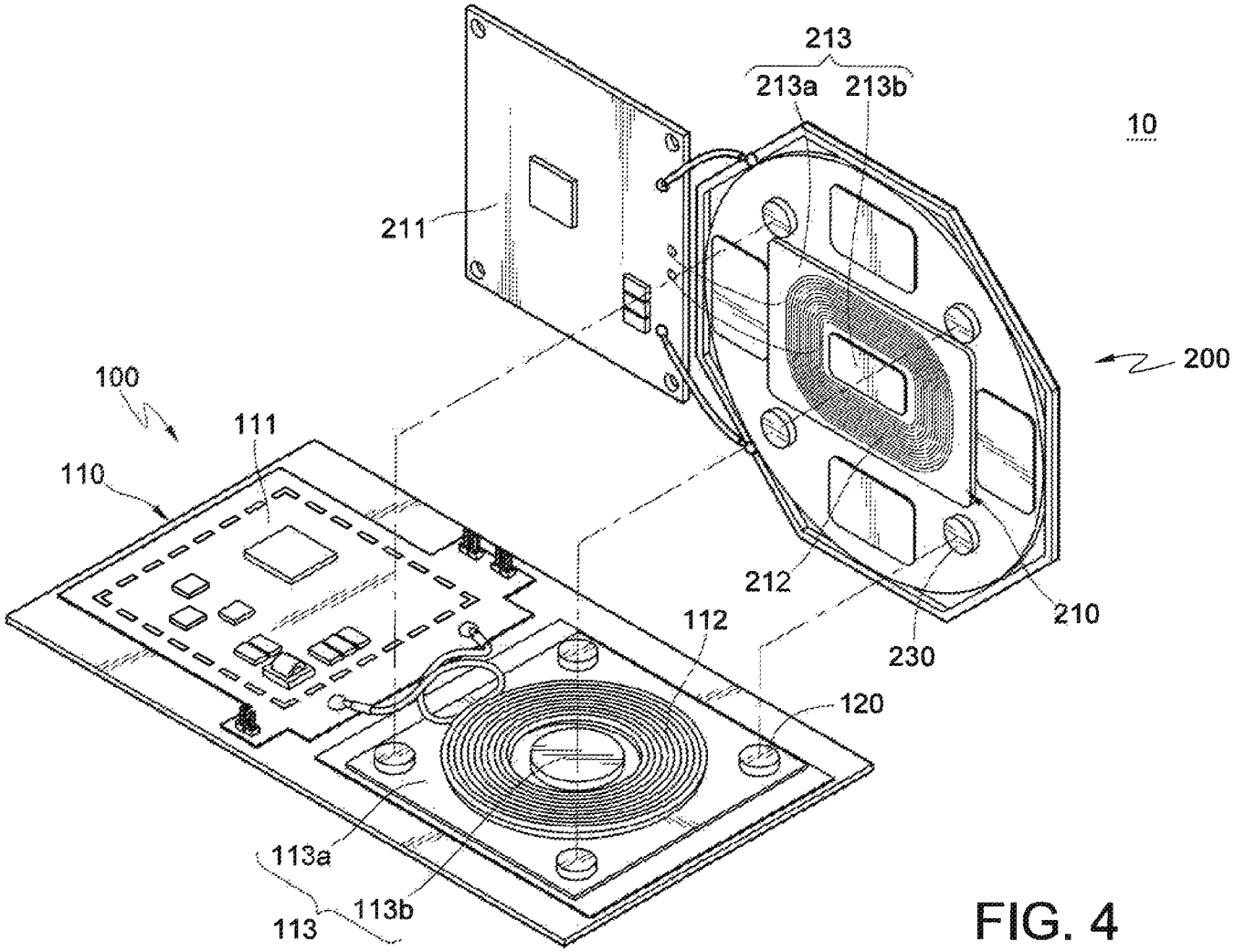
FIG. 4 is an exploded view of the lighting device according to a third embodiment of the disclosure.

In the lighting device 10 of the embodiment in FIG. 1, the light holder component 100 and the light source component 200 are assembled by the magnetic attraction force between the second magnet 113*b* and the fourth magnet 213*b*, but it should not be construed as a limitation to the disclosure. In other embodiments, a plurality of magnetic elements may be additionally disposed to enhance the strength of the magnetic attraction between the light holder component 100 and the light source component 200. Please refer to FIGS. 2 and 4. FIG. 4 is an exploded view of the lighting device according to a third embodiment the disclosure. This embodiment is similar to the embodiment in FIG. 1, and therefore the same parts will not be described herein again, only the differences between the two embodiments are described hereinafter.

The light holder component 100 further comprises at least a third magnetic element 120. The light source component 200 further comprises at least a fourth magnetic element 230. The third magnetic element 120 is attracted to the fourth magnetic element 230 in order to enhance the strength of the magnetic attraction between the light holder component 100 and the light source component 200. The quantity of the third magnetic element 120 and the fourth magnetic element 230 in this embodiment is four respectively, and the third magnetic elements 120 and the fourth magnetic elements 230 are disposed around the power supply coil 112 and the electric receiving coil 212 respectively, but it should not be construed as a limitation to the disclosure.

Figure 5:
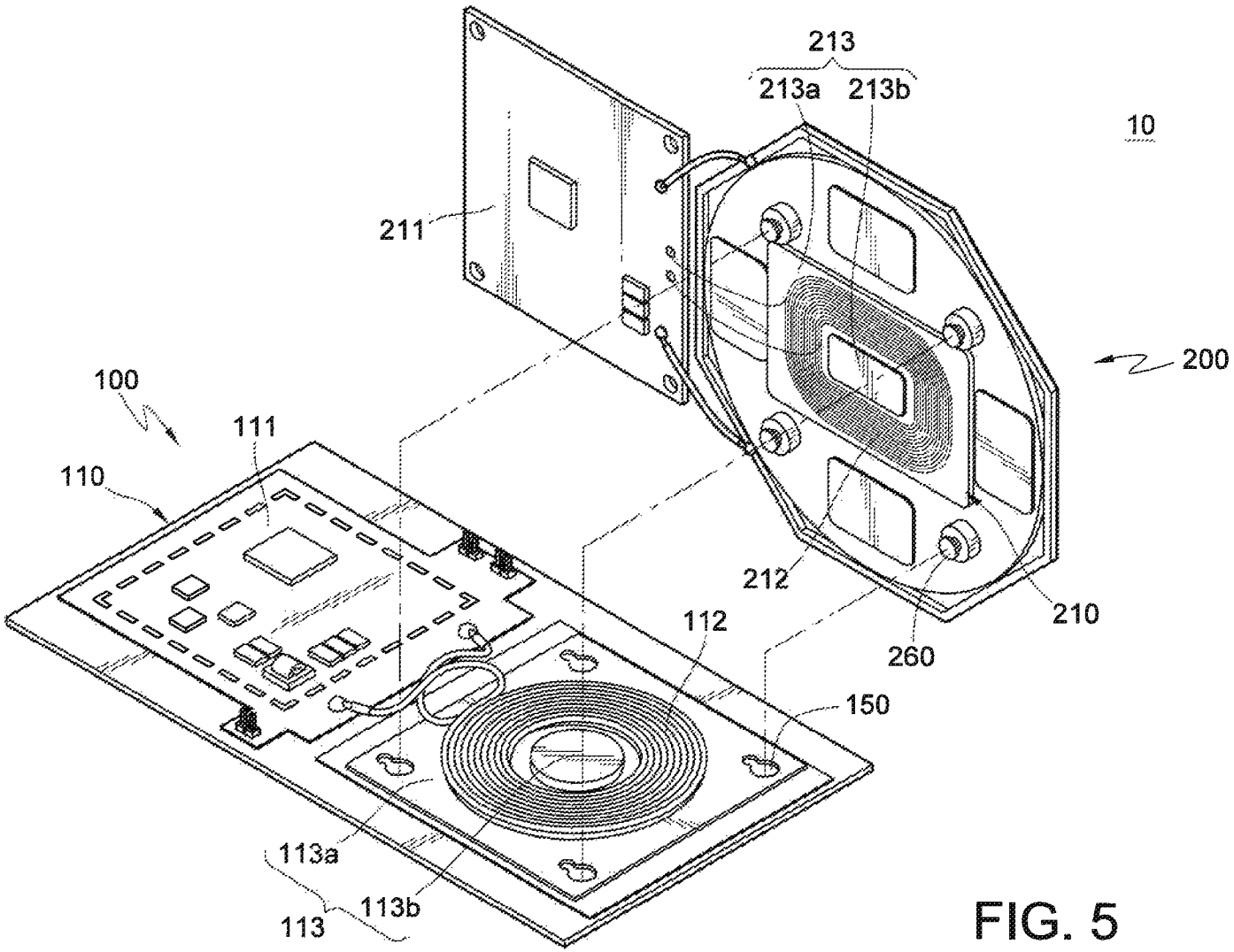
FIG. 5 is an exploded view of the lighting device according to a fourth embodiment of the disclosure.

Please refer to FIG. 5. FIG. 5 is an exploded view of the lighting device according to a fourth embodiment the disclosure. In this embodiment and other embodiments, the light holder component 100 further comprises four first fastening portions 150. The light source component 200 further comprises four second fastening portions 260. Furthermore, the first fastening portions 150 are calabash shaped holes and the second fastening portions 260 are fastening columns which match the calabash shaped holes. Thereby, the light source component 200 is configured for sliding relative to the light holder component 100 in order to fasten the first fastening portions 150 with the second fastening portions 260. However, the forms of the first fastening portions 150 and the second fastening portions 260 in this embodiment should not be construed as limitations to the disclosure. In other embodiments, the first fastening portions 150 and the matching second fastening portions 260 may be slide grooves, bolts and rivets.

According to the lighting device disclosed by the disclosure, the wireless power supply module is disposed on the light holder component and the wireless electric receiving module is disposed on the light source component. The light holder component and the light source component are attracted to each other by the magnetic elements in the wireless power supply module and the wireless electric receiving module respectively. Thereby, the light source component can be attracted to the light holder component speedily in order to enhance the efficiency of the assembling between the light source component and the light holder component.

Furthermore, because there are no electrical terminals or connectors directly contacted between the light source component and the light holder component, assembling staff will not be hurt, injured or electric shocked by contacting the electrical terminals or connectors during the installation of the light source component. Additionally, many of the tests for safety standards and requirements for lightings are able to be omitted.

Furthermore, the first coupling portions of the light holder component and the second coupling portions of the light source component are coupled together in order to enhance the reliability of assembling between the light source component and the light holder component.

Furthermore, the light holder component is additionally disposed with the at least a third magnetic element and the light source component is additionally disposed with the at least a fourth magnetic element. Thereby, the strength of the magnetic attraction between the light holder component and the light source component is able to be enhanced by the attraction between the third magnetic element and the fourth magnetic element.

What is claimed is:

1. A lighting device, comprising:

a light holder component comprising a wireless power supply module, the wireless power supply module comprising a first magnetic element; and a light source component comprising a wireless electric receiving module and at least one light source, the wireless electric receiving module comprising a second magnetic element, the light source being electrically connected to the wireless electric receiving module, a magnet of the first magnetic element and a magnet of the second magnetic element are physically attached to each other so that the second magnetic element is attracted to the first magnetic element to cause the light source component to dispose on the light holder component.

2. The lighting device according to claim 1, wherein the light holder component further comprises a first positioning portion, the light source component further comprises a second positioning portion, and the first positioning portion is detachably disposed in the second positioning portion.

3. The lighting device according to claim 1, wherein the light holder component further comprises a first coupling portion, the light source component further comprises a second coupling portion, and the first coupling portion is detachably coupled with second coupling portion.

4. The lighting device according to claim 3, further comprising a locking element, the locking element locking the first coupling portion with the second coupling portion.

5. The lighting device according to claim 1, wherein the light source is selected from one of the groups composed of the light emitting diode (LED) or the organic light emitting diode (OLED).

6. A lighting device, comprising:

a light holder component comprising a wireless power supply module, the wireless power supply module comprising a first magnetic element; and a light source component comprising a wire electric receiving module and at least one light source, the wireless electric receiving module comprising a second magnetic element, the light source being electrically connected to the wireless electric receiving module, the second magnetic element being attracted to the first magnetic element to cause the light source component to dispose on the light holder component, wherein the wireless power supply module comprises a power supply circuit and a power supply coil, the first magnetic element comprises a first magnet and a second magnet, the power supply coil and the second magnet are adhered on the first magnet respectively, the power supply coil surrounds the second magnet and is electrically connected to the power supply circuit, the wireless electric receiving module comprises an electric receiving circuit and an electric receiving coil, the second magnetic element comprises a third magnet and a fourth magnet, the electric receiving coil and the fourth magnet are adhered on the third magnet respectively, and the electric receiving coil surrounds the fourth magnet and is electrically connected to the electric receiving circuit.

7. The lighting device according to claim 6, wherein the second magnet and the fourth magnet have different magnetic poles, the second magnetic element is attracted to the second magnet of the first magnetic element through the fourth magnet.

8. The lighting device according to claim 6, wherein both the second magnet and the fourth magnet are permanent magnets.

9. The lighting device according to claim 6, wherein both the second magnet and the fourth magnet are soft magnets.

10. The lighting device according to claim 6, wherein the second magnet is a permanent magnet and the fourth magnet is a soft magnet.

11. The lighting device according to claim 6, wherein the second magnet is a soft magnet and the fourth magnet is a permanent magnet.

12. The lighting device according to claim 6, wherein the first magnet is a soft magnet and the third magnet is a soft magnet.

13. A lighting device, comprising:

a light holder component comprising a wireless power supply module, the wireless power supply module comprising a first magnetic element; and a light source component comprising a wire electric receiving module and at least one light source, the wireless electric receiving module comprising a second magnetic element, the light source being electrically connected to the wireless electric receiving module, the second magnetic element being attracted to the first magnetic element to cause the light source component to dispose on the light holder component, wherein the light holder component further comprises at least a third magnetic element, the light source component further comprises at least a fourth magnetic element, and the third magnetic element is attracted to the fourth magnetic element.

* * * * *